United States Patent [19]

Schrewe

[11] 3,994,334

[45] Nov. 30, 1976

[54] SUPPORTING CASTING IN A CONTINUOUS CASTING MACHINE BY MEANS OF EXCHANGEABLE SEGMENTS AS HOLDERS FOR SUPPORT ROLLS

[75] Inventor: Hans Schrewe, Duisburg, Germany

[73] Assignee: Mannesmann Aktiengesellschaft, Dusseldorf, Germany

[22] Filed: Apr. 30, 1975

[21] Appl. No.: 573,058

[30] Foreign Application Priority Data

May 28, 1974 Germany ..... 2425883
Dec. 2, 1974 Germany ..... 2457302

[52] U.S. Cl. ..... 164/282
[51] Int. Cl.[2] ..... B22D 11/14
[58] Field of Search ..... 164/282, 82, 283 R, 164/283 S, 283 M, 283 MS; 226/189, 194

[56] References Cited

UNITED STATES PATENTS

| | | | |
|---|---|---|---|
| 3,735,848 | 5/1973 | Bode et al. | 164/282 X |
| 3,763,923 | 10/1973 | Gallucci | 164/282 |
| 3,794,107 | 2/1974 | Bollig | 164/282 |

FOREIGN PATENTS OR APPLICATIONS

| | | | |
|---|---|---|---|
| 1,586,271 | 1/1970 | France | 164/282 |
| 26,442 | 11/1969 | Japan | 164/282 |

*Primary Examiner*—Richard B. Lazarus
*Assistant Examiner*—John S. Brown
*Attorney, Agent, or Firm*—Ralf H. Siegemund

[57] ABSTRACT

A curved withdrawal path for a casting is outlined by widely spaced rolls cooperating with individual segments holding more rolls and being radially retractible. The widely spaced rolls and the rolls on the segments compliment each other so that all rolls on the withdrawal path are equidistantly spaced.

9 Claims, 1 Drawing Figure

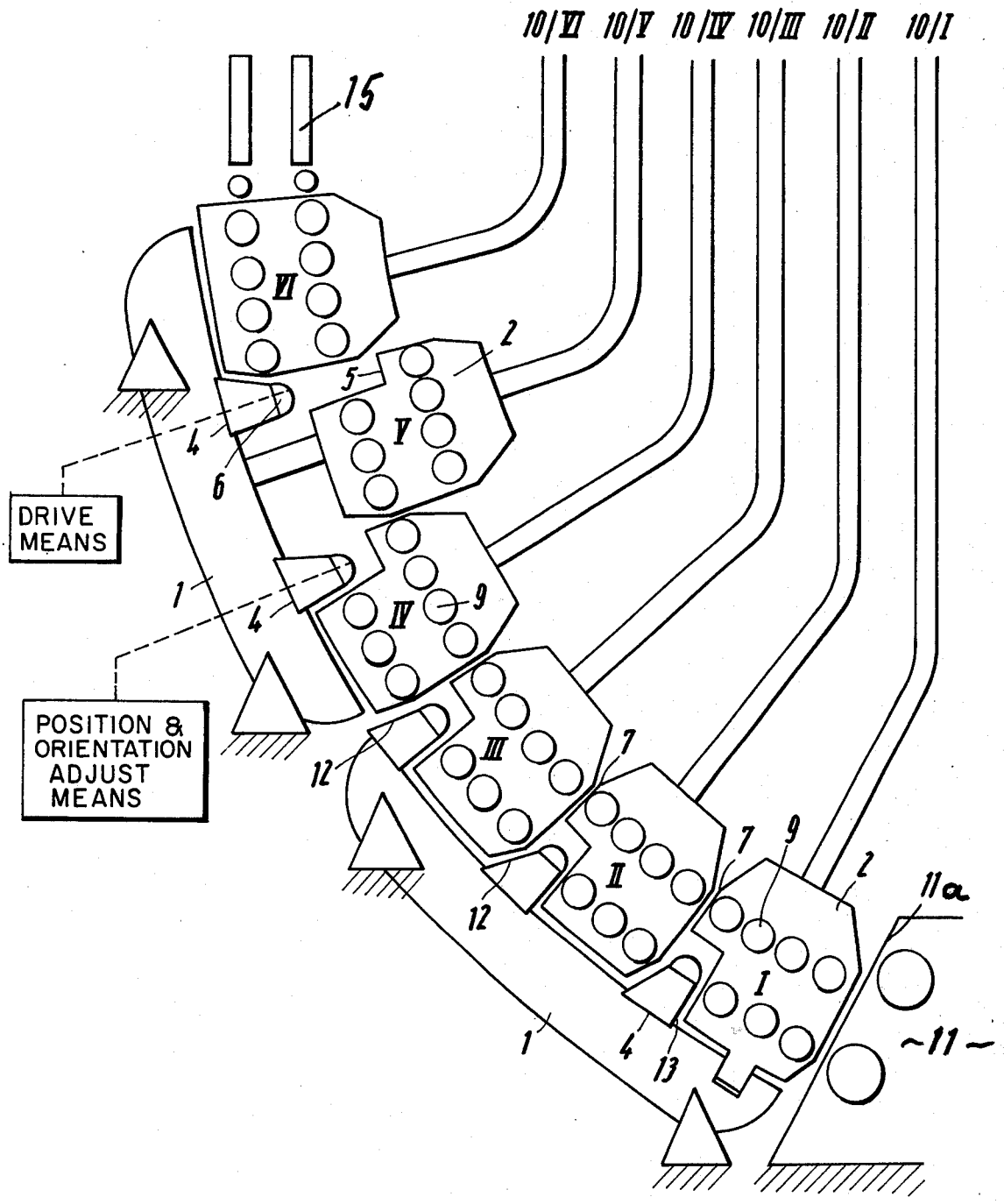
10/VI
10/V
10/IV
10/III
10/II
10/I
15
VI
2
5
V
4
6
DRIVE MEANS
1
4
IV
9
POSITION & ORIENTATION ADJUST MEANS
12
III
7
7
9
2
11a
II
12
I
1
4
13
~11~

SUPPORTING CASTING IN A CONTINUOUS CASTING MACHINE BY MEANS OF EXCHANGEABLE SEGMENTS AS HOLDERS FOR SUPPORT ROLLS

BACKGROUND OF THE INVENTION

The present invention relates to an arrangement for support and guiding of a casting as issuing from a continuous casting machine or installation, and more particularly the invention relates to guiding the casting in a curve by means of exchangeable support elements.

Continuous casting equipment includes guide and support rolls which are particularly provided and arranged to veer the casting from its vertically oriented movement on leaving the mold, to a horizontal direction. Occasionally the equipment is altered for producing a casting of different dimensions. Also, repairs have to be made on the guiding structure. Thus, the support rolls have in the past been mounted to permit e.g. lateral displacement (see for example U.S. Pat. No. 3,167,829). It is also known to provide for a curved guiding structure of the casting which permits folding away (down) when necessary (see for example Austrian Pat. No. 242,310). Either type of equipment requires considerable expenditure as far as the mechanics as well as space requirements is concerned. Moreover, these known stands have the specific disadvantage that upon failure of a single roll the entire guiding arrangement for the casting is affected.

The aforementioned drawbacks are particularly pronounced for continuously casting of slab ingots with rectangular cross-section at a height to width ratio of 1:3 or less. It has to be considered here that the continuous casting equipment requires special provisions to prevent bulging of the solidifying skin, while the core is still liquidous, and involving particularly the broad side of the slab. Particularly in the case of high casting speeds, thick castings and generally tall equipment, it is customary to construct the support equipment along the withdrawal path of the casting from several parts, also called support segments.

Generally speaking, the rolls can be equidistantly spaced in these known installations and for the entire support length of the issuing casting. However, if the vertical dimensions in the stand are increased, such as in the direction towards the center of the curvature, the equidistant spacing has to be disturbed in that the rolls of adjacent segments may now be spaced farther apart than the rolls in each segment along the radially outer portion of the withdrawal path for the casting; otherwise the withdrawal path would assume circle segment like configuration with a discontinuity from segment to segment. Removability of the segments remains however mandatory. On the other hand, the local increase in spacing between rolls favors bulging thereat, and the quality of the casting deteriorates because cracks may more readily form on the inside as well as on the outside of the casting. Moreover, large forces are reacted into casting if its dimensions are large. These forces result from thermally developed stress and resistance of the rolls, Thus, the support and holding equipment must be quite strong, particularly for holding the support segments in the direction of the forces acting along the path of the casting for withdrawing it. It can readily be seen that ease of removal and sturdiness of construction are opposing constraints.

DESCRIPTION OF THE INVENTION

It is an object of the present invention to provide new and improved equipment for guiding and supporting the casting as issuing from the mold of a curved continuous casting installation.

It is a specific object of the present invention to provide for a casting guiding and supporting assembly which includes equidistantly spaced support rolls but permits exchange of rolls, in the direction towards a center of the curved path of the casting as veered from the vertical to the horizontal.

In accordance with the preferred embodiment of the present invention, the guiding arrangement has a plurality of, preferably adjustable but operationally fixed first guide rolls which are relatively widely spaced. In addition, a plurality of support segments are provided and removably disposed along the path for retraction transversely to said path and each holding and journalling a plurality of second support and guide rolls whereby, so to speak, one roll is missing. When in operating position the segments have disposition to complete the withdrawal path for the casting, whereby each first guide roll of the plurality completes the set of rolls of a segment, the segments each have a recess so that the added roll can assume the proper position within the set to establish equidistant roll spacing throughout.

Each segment is preferably disposed on a rail, and adjacent segments engage along matching guide surfaces, having the orientation of the rail of one of the segments. The segments may have guide rail or slide surfaces for this purpose. The lowermost and stationary portion or continuation of the withdrawal path may have a corresponding slide surface for the lowermost segment.

Segments and stand (for the first guide rolls not mounted on the segments) are basically independent from each other. These guide rolls are preferably driven, so that the withdrawing forces, which basically increase from roll to roll in the direction of withdrawal, are actually reduced or at least increased to a lesser extent.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 illustrates somewhat schematically a side view of casting, guiding and supporting equipment in a continuous casting installation and incorporating the preferred embodiment of the invention.

Turning now to the detailed description of the drawings, the Figure shows a mold 15 for continuous casting through which a casting (strand, ingot, slab, etc.) leaves in vertical direction. The casting is to be veered to the horizontal, and the illustrated equipment guides and supports the casting on its path. This equipment includes frame and stand portions 1 which are firmly anchored to a base, foundation or the like. These frame parts 1 are also predetermined and fixed in their position and orientation.

The frame parts 1 carry several first guide rolls 6, journalled in bearing blocks 4 on the frame parts 1. The rolls 6 are preferably driven to relieve the withdrawal equipment (11) from the full force and load. The bearing blocks 4 may be adjustable as to their position, but operationally they are fixed, and the rolls 6 outline, so to speak, the withdrawal path for the casting, particularly the lower and radial-outward guide surface for the casting. Each bearing block has a more or less radial rear surface 13 and an oblique front surface 12.

Reference numeral 2 refers to guide segments which are additionally and individually identified by numerals, I, II, III, IV, V and VI. These segments 2 are positioned for sliding on rails 10 which are also individually identified by Roman numerals to provide for identifying association with the respective segments 2. The segments 2 are placed onto frame parts 1 by means of these rails 10, but can be retracted in, basically radial direction as far as the curved path is concerned.

Each segment has a recessed portion such as 5, and rolls 6 locate in the recesses 5 when the segments are placed on frame parts 1. Each segment 2 holds and journals seven rolls 9 these being the second rolls as defined earlier and the respective first roll 6 is the eighth one of the roll assembly as provided by each segment. The casting runs of course between the four rolls on one side and the three plus one rolls on the other, lower side.

The front walls of segments 2 (facing in the direction towards the mold) are provided with a guide portion 7, rails, slide surface or the like and having an inclination so that the segments will not bind when retracted towards the center of curvature of the path. This is the one aspect of the segment constructed for this purpose, the other is the fact that these particular slide surfaces do not extend all the way down but end at the recess into which a roll 6 projects.

Referring now to certain details of the orientation, rail 10/I for segment 2/1 has the same inclination in the vicinity of lower stand part 1 as the entrance 11a for guide and withdrawal track 11 as pulling the casting along its path. That portion 11 continues the withdrawal path, basically in the horizontal. The end or side face of segment 2/1 facing entrance 11a can, therefore, slide over the latter when the segment 2/I is retracted on its rail 10/I. Whether or not these surfaces slide on each other so that **11*a*** becomes a load bearing surface is optional, but preferred. Decisive is the choice of a parallel orientation as defined.

The guide surface 7 of segment 2/I has the same inclination as the lower part of rail 10/II and the adjacent surface of segment 2/II has matching contour so that segment 2/II when retracted can slide on the surface 7 of segment 2/I. The guide surface of 7 of segment 2/II has the same inclination as the rail 10/III, and the facing surface of segment 2/III can slide thereon when segment 2/III is retracted etc.

The bearing blocks 4 have steeper surfaces 12 where facing the casting. These surfaces 12 provide for camming action as they are used to lift segments 2 off their engagement with the respective guide surface 7 of the segment below so as to particularly position the rolls of the respective segment into equidistant spacing with the respective associated roll 6. Therefore, the surfaces 7 are not load bearing surfaces during casting operation, only during retraction of a segment.

The upper segment, 2/VI, has its full set of rolls as problems do not exist here as to the retraction of that segment. Each segment is retractible, basically in the direction towards the center of curvature of the withdrawal path, which, in the raw, is outlined by stand and frame parts 1 and by the guide rolls 6 thereon. Each segment when retracted runs on a rail such as 10; the segments will not interfere with any equipment next to the one illustrated, nor with each other. Moreover, the segments can slide on eacch other, by means of the slide surface or rails 7, and the lowermost segment (2/I) can glide in the inclined surface **11*a*.**

In the final position along the withdrawal path, a roll 6 is, so to speak, inserted inbetween the three lower rolls 9 of one segment and the three lower rolls 9 of the next segment, whereby equidistant spacing is made possible. The particular segments may be displaced by others to accomodate for example thicker or thinner castings. The rolls 6 however, become part of each pattern of guide rolls.

The Figure shows one of the segments retracted. The segments can be retracted on their respective rails independently from each other, because each segment, such as 2/V on being retracted slides on the surface 12 of the respective segment 7 below (2/IV) which motion has a component in azimuthal direction, whereby the segment 2/V recedes from the one above (2/VI) and moves towards the slide surface 7 of the segment 2/IV on which it continues its movement radially upon further retraction and movement out of the assembly. The slide surface 7 of the retracting segment 2/V has in the meantime sufficiently receded from the segment 2/VI above, so that the retraction, even though having a slight angle to the slide surface 7 of 2/V and the segment, 2/VI, above, will not bind.

The invention is not limited to the embodiments described above, but all changes and modifications thereof not constituting departures from the spirt and scope of the invention are intended to be included.

I claim :

1. Guiding and support arrangement for a casting issuing from a mold of a continuous casting machine having a stand structure, comprising:

a plurality of first guide rolls arranged in spaced-apart relation along a path for guiding said issuing casting;

a plurality of bearing blocks respectively journalling said first guide rolls in said stand structure; and a plurality of support segments, removably disposed at said path, each segment of the plurality of support segments holding and journalling a particular number of upper and lower second guide rolls, the segments being associated with said first guide rolls of said plurality of first guide rolls, each of which respectively provides an additional lower roll, so that a lower track path is established by the lower second guide rolls on the segments and by the plurality of first guide rolls.

2. Arrangement as in claim 1, and including a plurality of rails, one for each segment to move the segments into and out of position in relation to said path.

3. Arrangement as in claim 2 wherein the said path is curved, the rails being essentially radially in relation to said curved path.

4. Arrangement as in claim 3, wherein a continuation of the path includes support surfaces on said bearing blocks, each segment of the plurality of segments having a matching surface adjacent to a support surface for engagement therewith which provides for sliding movement of said segments along the support surfaces and matching surfaces in engagement therewith.

5. Arrangement as in claim 2 wherein respective adjacent segments have guide surfaces for mutual engagement and having a direction and orientation matching direction and orientation of one of the rails for one of the two segments.

6. Arrangement as in claim 1, the first guide rolls of the plurality of guide rolls being independently arranged from the segments of the plurality of segments.

7. Arrangement as in claim 1, including means for driving the first guide rolls of the plurality of guide rolls.

8. Arrangement as in claim 1 wherein the bearing blocks are mounted for adjustment of their orientation and position.

9. Arrangement as in claim 1 wherein the bearing blocks have cam surfaces for acting on and positioning the respective adjacent one of the segments.

* * * * *